US006120733A

United States Patent [19]

Goodman et al.

[11] Patent Number: 6,120,733

[45] Date of Patent: Sep. 19, 2000

[54] SELF-CONTAINED ASSAY DEVICE

[76] Inventors: David B. P. Goodman, 1201 Grenox Rd., Wynnewood, Pa. 19096-2218; Michael B. Prystowsky, 263 Sterling Rd., Harrison, N.Y. 10528

[21] Appl. No.: 08/969,176

[22] Filed: Nov. 12, 1997

[51] Int. Cl.[7] ..... G01N 33/48

[52] U.S. Cl. ..... 422/61; 422/63; 422/64; 436/177

[58] Field of Search ..... 42/61, 58, 63, 42/64; 436/45, 177

[56] References Cited

U.S. PATENT DOCUMENTS

| | | | |
|---|---|---|---|
| 3,713,779 | 1/1973 | Sirago et al. . | |
| 3,801,283 | 4/1974 | Shapiro et al. | 422/64 |
| 4,522,923 | 6/1985 | Deutsch et al. . | |
| 4,608,231 | 8/1986 | Witty et al. . | |
| 4,623,461 | 11/1986 | Hossum et al. . | |
| 4,769,333 | 9/1988 | Dole et al. . | |
| 4,837,159 | 6/1989 | Yamada . | |
| 4,844,868 | 7/1989 | Rokugawa | 422/64 |
| 4,857,453 | 8/1989 | Ullman et al. . | |
| 4,859,419 | 8/1989 | Marks et al. . | |
| 4,859,421 | 8/1989 | Apicella . | |
| 4,918,025 | 4/1990 | Grenner . | |
| 4,978,502 | 12/1990 | Dole et al. . | |
| 4,978,504 | 12/1990 | Nason . | |
| 4,981,786 | 1/1991 | Dafforn et al. . | |
| 5,078,968 | 1/1992 | Nason . | |
| 5,089,230 | 2/1992 | Kondo et al. | 422/64 |
| 5,137,808 | 8/1992 | Ullman et al. . | |
| 5,147,780 | 9/1992 | Pouletty et al. . | |
| 5,162,237 | 11/1992 | Messenger et al. . | |
| 5,162,238 | 11/1992 | Eikmeier et al. . | |
| 5,164,318 | 11/1992 | Sato et al. . | |
| 5,169,789 | 12/1992 | Bernstein . | |
| 5,288,463 | 2/1994 | Chemelli | 422/58 |
| 5,501,837 | 3/1996 | Sayles | 422/58 |
| 5,639,424 | 6/1997 | Rausnitz | 422/61 |

*Primary Examiner*—Lyle A. Alexander
*Attorney, Agent, or Firm*—Pennie & Edmonds LLP

[57] ABSTRACT

The present invention relates to a self-contained assay device which is capable of detecting various analyte(s), including bioanalytes, in specimens for example, from biological sources. The assay device includes a first housing and a specimen holder rotatably fit in the first housing. The specimen holder has a center portion, a circular flange surrounding the center portion and a pin member extending from the underneath of the center portion. The center portion has a radial slot extending from its peripheral end toward a closed end. A spring/latch assembly is adapted to be held in the slot on the specimen holder and includes a spring member disposed in the slot near its closed end, a latch member having a remote end and a plurality of plunger members. The assay device also includes a second housing, preferably a cam-plate fixedly fit in the first housing. The cam-plate has a rim portion surrounding a concave portion adapted to accommodate the center portion of the specimen holder and an opening on the rim portion for adding a specimen to be tested. When the specimen holder is rotated relative to the cam-plate, the remote end of the latch member moves along the rim portion and thrusts into each chamber to drive the plunger member to release a reagent (or wash solution) for testing an analyte(s) in a specimen.

26 Claims, 10 Drawing Sheets

SELF-CONTAINED ASSAY DEVICE

FIELD OF THE INVENTION

The present invention relates generally to a self-contained assay device, which is capable of detecting various analytes, including bioanalytes, in specimens, for example, from biological sources. More particularly, the present invention relates to a self-contained disposable assay device for a rapid and convenient detection of analyte(s) by the use of a specific binding pair, such as antibody/antigen, polynucleotide/complementary polynucleotide, ligand/receptor, enzyme/substrate and enzyme/co-factor, etc. The present invention further relates to a method of using the self-contained assay device, either in a hand-held or automated mode.

BACKGROUND OF THE INVENTION

In testing blood or other fluid samples for medical evaluation and diagnosis, a rapid and simple assay is usually needed by medical professionals. Over the years, various devices and methods have been developed for assaying analytes in specimens of biological origin.

U.S. Pat. No. 4,522,923 discloses ar apparatus containing a test tube with at least three chambers each containing different chemicals, including a solid sphere, and separated from each other by a water-soluble barrier.

U.S. Pat. No. 4,623,461 discloses a transverse flow diagnostic device containing absorbent mears associated with the peripheral zone of a filter.

U.S. Pat. No. 4,608,231 discloses a self-contained reagent package device containing a plurality of wells in the support member.

U.S. Pat. No. 4,769,333 discloses a personal, disposable hand held diagnostic kit having specimen support member. The specimen support member carries a plurality of receptacles for containing liquid materials. The receptacles are later cut in sequence to release the liquid.

U.S. Pat. No. 4,837,159 discloses an automatic chemical analyzer including a turntable rotated intermittently at a constant pitch and holding a number of reaction vessels.

U.S. Pat. No. 4,857,453 discloses a device for conducting an immunoassay containing a means in the housing for introducing a sample into the device and a self-contained liquid reagent in a breakable container.

U.S. Pat. No. 4,859,421 discloses a disposable antigen concentrator and detector containing a reagent storage chamber connected to the reaction chamber through a valve means which allows fluid flow from the reagent chamber to the reaction chamber.

U.S. Pat. No. 4,859,419 discloses an apparatus for immunoassay of multiple samples of biological fluids containing a frame having plural test vessels.

U.S. Pat. No. 4,918,025 discloses a self-contained immunoassay element including a capillary containing a fixed reagent in fluid communication with reagent reservoirs.

U.S. Pat. No. 4,978,502 discloses a device containing a molded, flexible blister having an open side and a structure for rupturing the blister closure ir response to relative motion between the blister and test specimen support members.

U.S. Pat. No. 4,981,786 discloses a multiple port assay device containing a housing means for capturing a first member of a specific binding pair in a zone and for allowing liquid to be transported by capillary action away from the zone.

U.S. Pat. Nos. 4,978,504 and 5,078,968 disclose a specimen test unit containing a specimen collecting swab and a reagent-containing ampoule in cylindrical housing which can be bent or squeezed or otherwise deformed to fracture a reagent-containing ampoule.

U.S. Pat. No. 5,137,808 discloses a liquid reagent in a breakable container utilized for the determination of an analyte in a sample, and liiquid reagents in a container which pass into a second container when a seal is ruptured.

U.S. Pat. No. 5,147,780 discloses an apparatus for the detection of analytes containing a liquid medium restrained from a sample absorbing nib by a frangible barrier which is broken allowing the nib to drop into the liquid medium.

U.S. Pat. No. 5,162,237 discloses an analytical reaction cassette for performing sequential analytical assays by non-centrifugal and noncapillary manipulations.

U.S. Pat. No. 5,162,238 discloses a test carrier for the analysis of a sample liquid containing a sample application zone, a covering mesh, an erythrocyte separation layer, two reagent layers and a liquid transport layer made of an absorbent material.

U.S. Pat. No. 5,164,318 discloses an automatic analyzer for performing immunoassays containing a sample carrying rotary disk supporting rotation of a plurality of sample cups for containing a sample.

U.S. Pat. No. 5,169,789 discloses a self-contained solid phase immunodiffusion assay containing a tube having a sample collector and compartmentalized reagents separated by seals which can be broken through pressure on the sample collector, mixed with reagent, and pushed into a ligand receptor reaction area.

There still remains a need in the art for a self-contained, inexpensive, disposable assay device for detecting an analyte member of a specific binding pair. More specifically, there is a need for an assay device that can be used easily and effectively by untrained personnel, preferably without the need for complex additional instruments to complete the detection of analyte. The present invention provides such an economical, compact, easy to operate and self-contained assay device for detecting an analyte in a sample, such as a biological sample, which meets the requirements.

SUMMARY OF THE INVENTION

The present invention relates to a self-contained assay device capable of detecting various analyte(s), including bioanalytes, in specimens from various sources such as a biological source, an ecological or environmental source, a toxic industrial source, etc. The assay device has a first housing and a specimen holder rotatably fit in the first housing. The specimen holder has a center portion surrounded by a circular flange and a pin member extending from underneath of the center portion. The center portion has a radial slot for holding a spring/latch assembly therein. The spring/latch assembly has a spring member, a latch member with a remote end and a plurality of plunger members.

The self-contained assay device according to the present invention also includes a second housing fixedly fit in the first housing. The second housing is preferably in the form of a cam-plate and has a rim portion surrounding a concave portion adapted to accommodate the center portion of the specimen holder. The cam-plate also includes an opening on the rim portion for adding a specimen to be tested into the assay device.

The cam-plate has a plurality of cam-shaped chambers provided in its rim portion and communicating with the concave portion. Each chamber has an apex portion located furthest away from the concave portion and a cam side extending from the apex portion toward the next chamber. An inner bore member communicates with the apex portion of each chamber and extends radially into the rim portion terminating at a dead end. The inner bore member holds a predetermined reagent or wash solution at its dead end and is sealed by one of the plunger members of the spring/latch assembly. The plunger member is at least partly held in the inner bore member and adapted to be slidely fit in the inner bore member. The cam-plate also has an outlet provided near its dead end for releasing the reagent contained in the inner bore member onto the circular flange of the specimen holder. The outlet can have an enlarged bottom forming a recess to prevent capillary action.

The plunger member has a sealing end fit in the bore member in a water-tight fashion and a guiding shoulder slidely fit in the bore member. In addition, the latch member can have a traverse handle which extends out of the cam-plate through a center hole thereon.

When the specimen holder is rotated relative to the cam-plate, the remote end of the latch member moves along the rim portion and thrusts into each chamber. The spring member then drives the latch member radially outward and the latch member, in turn, forces the plunger member further into inner bore member to dispense the reagent or wash solution contained therein. The reagent can thus be released, through the outlets, onto the specimen holder to react with a specimen added in advance to test for the presence of an analyte in the specimen. Any excess fluid can be absorbed by a blotter member inserted between the first housing and the bottom of the specimen holder. In a preferred embodiment, a membrane member, is positioned on the specimen holder and the reagent is released onto the membrane member holding the specimen on the specimen holder.

The first housing, the specimen holder, the latch member, the plunger member and the cam-plate of the assay device can all be made of clear or transparent plastic material, including, but not limited to, such acrylic. As will be understood by those skilled in the art, any polymeric plastic material that is water-tight and can be easily molded is suitable for fabricating the above-mentioned components. The advantage of using a transparent material is that it is easy for the user to visually observe the result(s) of reactions carried out in the assay device with an unaided eye. In one embodiment, the above-mentioned components are made of colored plastic. In addition, the specimen holder can be made of translucent or cloudy plastic.

Alternatively, any one or more of the first housing, the specimen holder, the latch member, the plunger member and the cam-plate of the assay device can be made of clear colored or cloudy or opaque colored plastic material. If the cam-plate is of cloudy or opaque material, the cam-plate further includes a second opening, preferably a through hole on the rim portion, i.e., an observation hole, positioned at or above or preferably aligned with the end position (described herein below) so that when the specimen holder has been rotated to the end position, the results can be observed through the observation hole to determine the presence or absence of analyte(s) in the specimen. The observation hole can be fitted with a cover which can be removed to permit observation of the results, either via the unaided eye or by means of appropriate instrumentation, and which can be replaced afterwards to completely seal the specimen and reagents within the used self-contained assay device before disposal.

The self-contained assay device of the present invention can further comprise first and second retainer members which are located in the rim portion of the cam-plate and determine a start position and an end position of the assay device. The first retainer member and the opening of the cam-plate through which a specimen is introduced into the device are preferably located in the same radial direction. In a preferred embodiment, the first and second retainer members are nitch and slot members.

The number of the cam-shaped chambers can be from 2 to 8 and preferably from 4 to 6. In a preferred embodiment, there are four cam-shaped chambers. The apex portions of these chambers and the first and second retainer members are evenly distributed along the rim portion.

The assay device can also comprise a receptacle adapted to be attached to the opening of the cam-plate for introducing a specimen into the assay device. A knob member is used to provide grip mechanism for the rotation of the assay device. The knob member has a center hole for fixedly fitting onto the pin member of the specimen holder. In addition, the remote end of the latch member can be a curved tip portion to facilitate the relative rotation between the specimen holder and the cam-plate. The spring member is a compressed spring.

The present invention further relates to a method for detecting an analyte in a specimen. The detecting method comprises the steps of: (a) providing a self-contained assay device as described herein, (b) adding a specimen of a predetermined quantity into the assay device through the opening on the cam-plate, (c) rotating the specimen holder relatively to the cam-plate to move the spring/latch assembly from a start position toward a first chamber till the spring/latch assembly enters the first chamber and its associated bore member to dispense a reagent sealed therein, (d) rotating the specimen holder relatively to the cam-plate to move the spring/latch assembly to the next chamber to dispense a reagent or wash solution retained therein, (e) repeating the above step (d) till the spring/latch assembly reaches the last chamber and dispenses a reagent or wash solution retained therein, (f) rotating the specimen holder relatively to the cam-plate to move the spring/latch assembly from the last chamber to an end position and (g) observing the results to determine the presence or absences of the analyte(s) in the specimen. Rotation of the specimen holder can be accomplished manually or by means of an automated operating apparatus. Observation of the results; can also be accomplished either by eye or by means of an automated reader.

BRIEF DESCRIPTION OF THE DRAWINGS

These and other features, aspects, and advantages of the present invention will become much more apparent from the following description, appended claims, and accompanying drawings, in which:

FIG. 6*d* is a side view of the specimen holder with the membrane member of FIGS. 6*a* to 6*c* attached to it;

DETAILED DESCRIPTION OF THE PREFERRED EMBODIMENTS

Figure 1A:
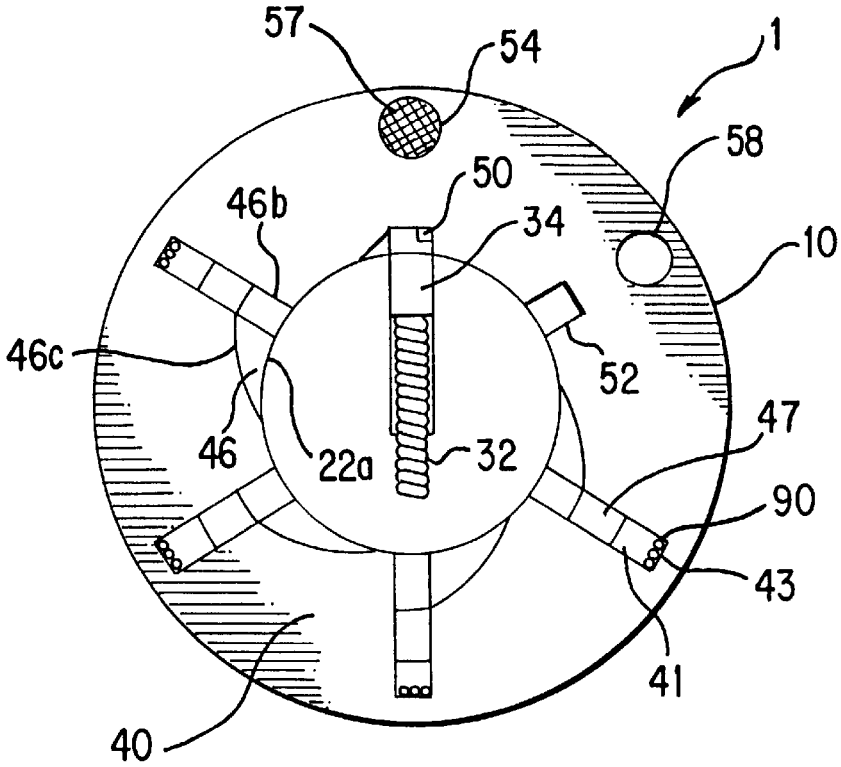
FIGS. 1*a* and 1*b* are a top view and a cross-section of a preferred embodiment of the self-contained assay device according to the present invention.
Figure 1B:
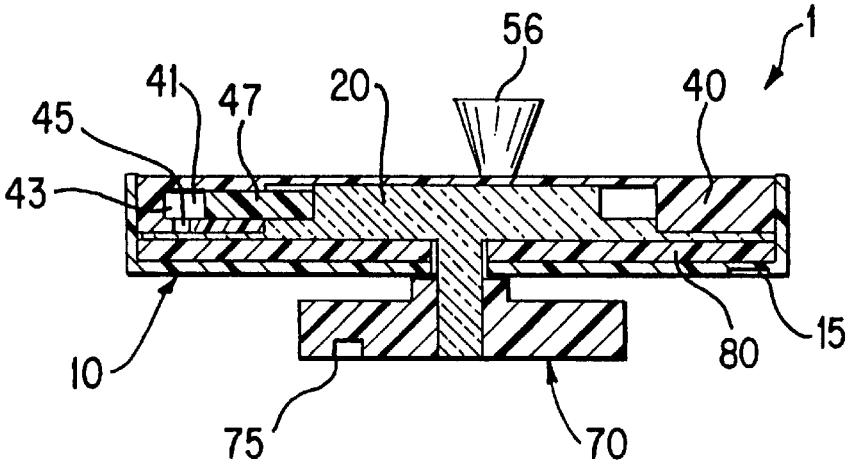

Various self-contained assay devices embodying the principles of the present invention are illustrated in FIGS. 1–12. Such self-contained assay devices have a compact structure and are inexpensive to make. Therefore, they can be easily carried for conducting rapid detection of analyte(s) on site. The self-contained assay device can be conveniently discarded after use. In each embodiment, the same elements are designated with the same reference numerals and repetitive descriptions are omitted.

FIGS. 1*a* through 3*b* show different embodiments of a self-contained assay device 1 of the present invention. The assay device 1 has a first housing 10 for encasing a specimen holder 20. The specimen holder 20 holds a spring/latch assembly 30 (FIG. 3*b*), which is adapted to move radially in the assay device 1. The spring/latch assembly 30 includes a spring member 32, a latch member 34 and a plurality of plunger members 47. A second housing 40, preferably a cam-plate, is tightly fit within the first housing 10 and thus fixed thereto, while the specimen holder 20 is rotatable relative to the first and second housings 10 and 40. The cam-plate 40 has a plurality of chambers 46 each having an inner bore member 41 containing a reagent or wash solution 90 therein. Each inner bore member 41 has an outliat 45, through which the reagent or wash solution 90 can be dispensed onto the specimen holder 20, preferably onto a membrane member 29 fixed to the specimen holder 20 as described later. The cam-plate 40 also has an opening 54 thereon for introducing a specimen into the assay device 1.

Figure 4A:
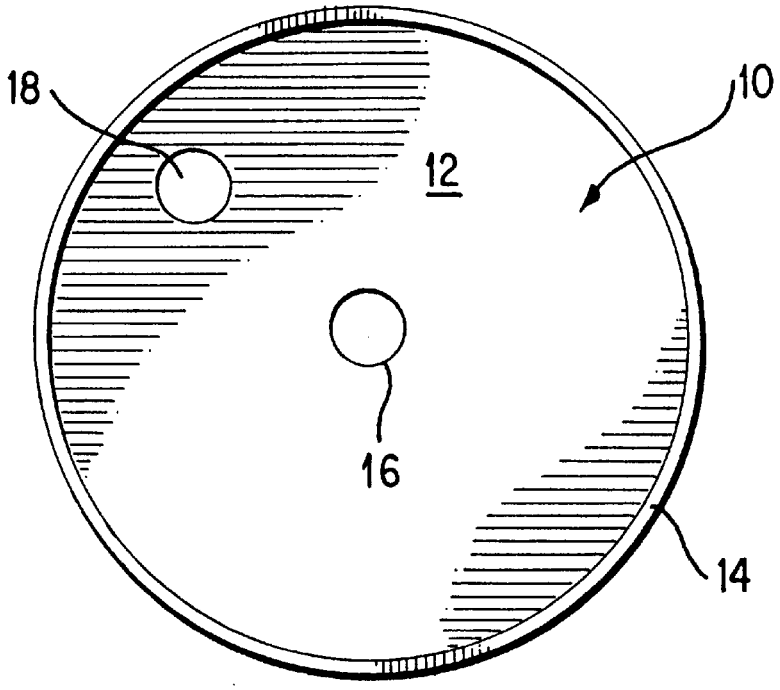
FIGS. 4*a* and 4*b* are top and side views of the first housing in the self-contained assay device in FIG. 3.
Figure 4B:
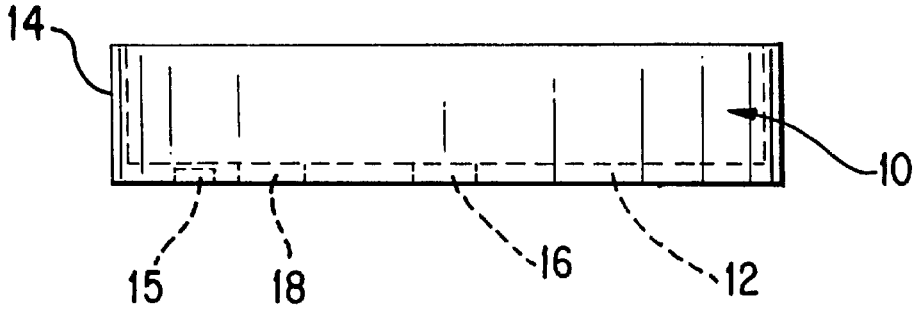

As shown in FIGS. 4*a* and 4*b*, the first housing 10 of the self-contained assay device 1 consists of a bottom plate 12 and an upstanding wall 14. The upstanding wall 14 has a height so that the first housing 10 can accommodate both the specimen holder and the cam-plate 40 as will be described later. Preferably, the bottom plate 12 has a circular shape and thus the upstanding wall 14 is also circular. A through hole 16 is formed in the center of the bottom plate 12 for passing a pin member 24 on the specimen holder as will be described later.

In a preferred embodiment, the first housing 10 has a through hole 18 thereon. Such a through hole 18 is designed for the user to observe the final result of the assay reactions. As will be described hereinafter, the through hole 18, together with other openings or apertures on the second housing, the specimen holder and the blotter member is particularly useful when these components are non-transparent.

Further, the first housing 10 of the assay device 1 can optionally have an orientating device 15 provided at its bottom. The orientating device 15 is adapted to engage with a complemental orientating device on an automatic operating apparatus to thus ensure the first housing 10 is properly positioned in the operating apparatus for an automated operation as will be described later. In an embodiment, the orientating device 15 on the first housing 10 is in the form of a recess member, which is engagable with a key member on the operating apparatus.

The first housing 10 of the assay device 1 can be made of various materials and by various processes. Materials, such as plastics, are preferred for their inexpensive cost and non-erosive features. In an embodiment, the first housing 10 is molded or otherwise fabricated of clear or transparent plastic material. Acrylic is one illustrative non-limiting example of a suitable plastic material. As will be understood by those skilled in the art, any of a number of other polymeric plastic materials are suitable for fabricating the assay device of the present invention. One advantage of using such a transparent plastic material is that it is easier for the user to visually observe, with an unaided eye, the elements housed in the first housing 10 and to determine whether a chemical reaction or binding has occurred in the assay device 1.

Figure 5A:
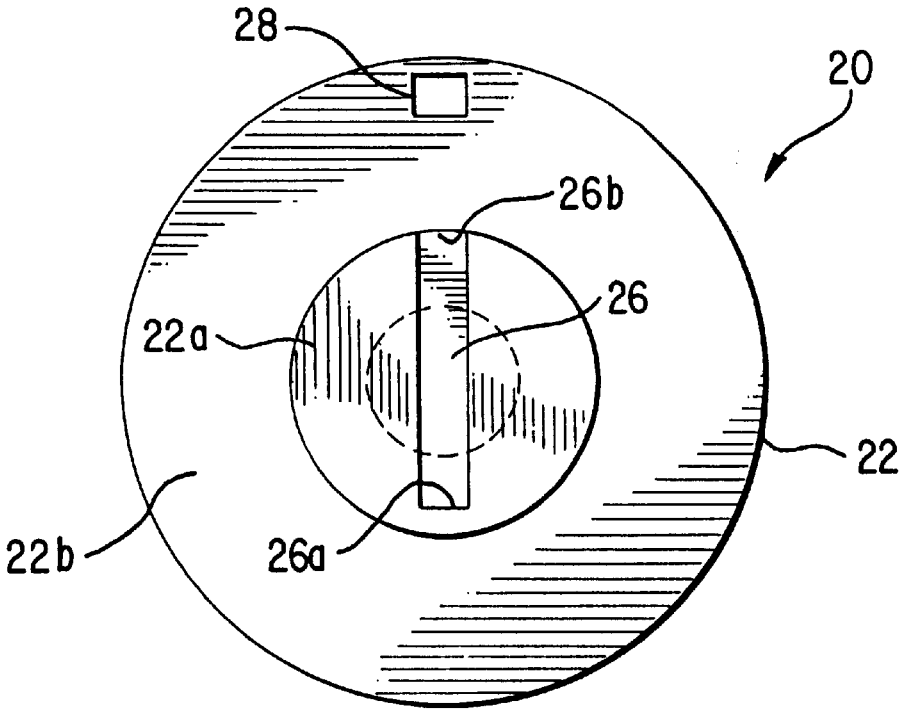
FIGS. 5*a* and 5*b* are top view and cross-section of the specimen holder in the assay device in FIG. 3.
Figure 5B:
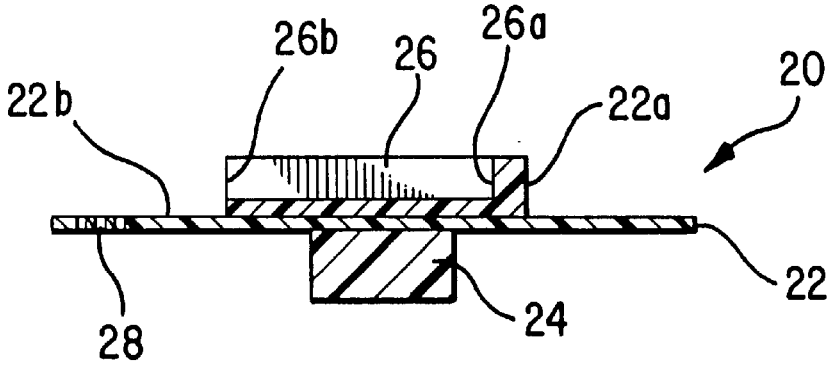

The specimen holder 20, as shown in FIGS. 5*a* and 5*b*, is in the shape of a circular plate 22 with a pin member 24 extending from underneath and at the center thereof. The circular plate 22 is dimensioned to be loosely fit and freely rotatable inside the upstanding wall 14 of the first housing 10 after assembling. The specimen holder 20 can also be made of various materials and by various processes. Similar to that with the first housing 10, materials, such as polymer plastics, are preferred for making the specimen holder 20. In an embodiment, the specimen holder 20 is molded of clear acrylic either with or without color. Moreover, the specimen holder 20 can be made of translucent or cloudy plastic.

The circular plate 22 of the specimen holder 20 is stepped to form a center portion 22*a* and a circular flange 22*b* surrounding the center portion 22*a*. The center portion 22*a* has at least one slot 26 extending radially from its periphery toward its center for accommodating a spring/latch assembly 30 as will be described later. The slot 26 has a closed end 26*a* and open end 26*b* near the periphery of the center portion 22*a*. The number of the slot 26 can be one or more depending on the nature of the test assays to be performed using the assay device 1.

One main function of the circular flange 22*b* is to hold the specimen to be examined suspected of containing one or more analyte(s) and/or other reagents. As described later, the added specimen is deposited on the circular flange 22*b* of the specimen holder 20 at a position to which the slot 26 opens. Such a position is designated by reference numeral 28 in FIG. 5*a*. In a preferred embodiment as shown in FIG. 5*b*, the position 28 has pores or channels to allow liquid to pass therethrough. In this manner, any unbound specimen or excess reagent (or wash solution) 90 can pass through position 28 of the specimen holder 20 after each reaction or washing process and be deposited on a blotter member 80 as will be discussed hereinafter.

Figure 6A:
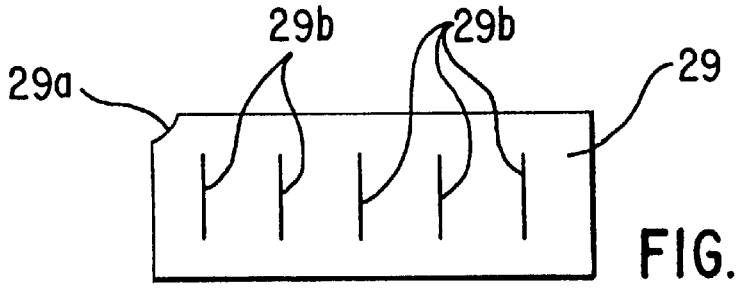
FIGS. 6*a*, 6*b*, 6*c* and 6*d* show various membrane members
Figure 6B:
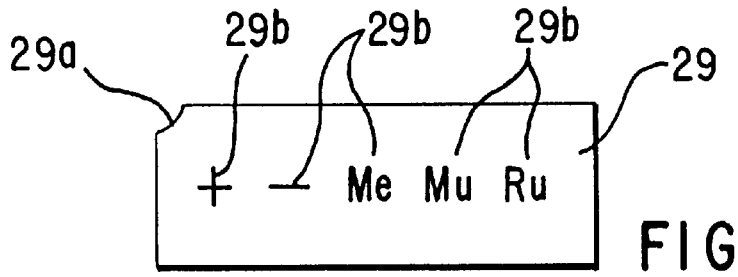
Figure 6C:
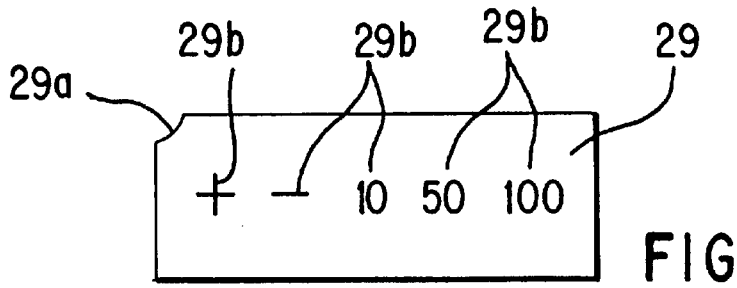
Figure 6D:
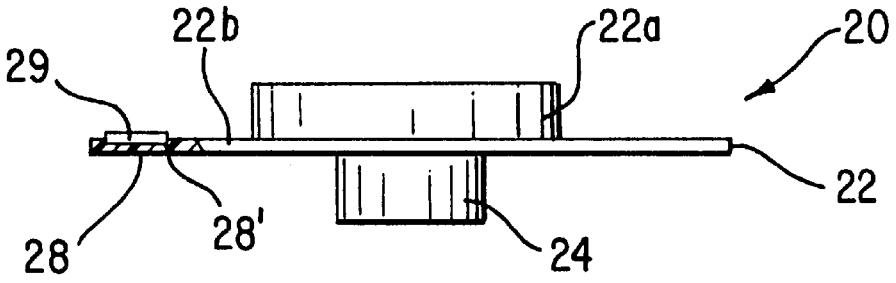

In an alternative embodiment, a membrane member 29 (FIG. 6) can be provided on the circular flange 22*b* of the specimen holder 20 at position 28, as shown in FIG. 6*d*. The membrane member 29 is made of a porous material including but not limited to such as nitrocellulose, etc. In addition, the position 28 on the specimen holder 20 has pores or channels similar to those described above to allow liquid to pass therethrough. Thus, unbound specimen or reagent or wash solution 90 is allowed to pass through the membrane member 29 and position 28 onto the blotter member 80, while the bound specimen or reagent 90 is immobilized by the membrane member 29 for subsequent reaction or examination as will be described hereinafter.

The membrane member 29 can be retained in place through various conventional methods such as adhesion, embedment, insertion, etc. In the preferred embodiment as shown in FIG. 6*d*, the circular flange 22*b* of the specimen holder 20 has a cut-out portion 28' at position 28. The cut-out portion 28' can be in the form of a through hole. Thus, the membrane member 29 can be inserted in the cut-out portion or the through hole 28' and retained therein.

In certain embodiments, the membrane member 29 can immobilize one member of a specific binding pair, which is complementary to the analyte(s) to be detected, on a portion 29*b* (FIG. 6*a*) of the membrane member 29 to serve as a "capture site" for any analyte in the specimen. For example, if the analyte to be detected is an antibody, the antigen to which the antibody binds specifically can be immobilized on a predetermined area or zone, 29*b*, of the membrane member 29. As another example, if the analyte to be detected is an antigen, an antibody to which the antigen binds specifically can be immobilized on a predetermined area or zone, 29*b*, of the membrane member 29. In either mode of this embodiment, the first bore member contains a wash solution and the remaining members contain reagents and/or wash solution, for the signal system.

Further, the membrane member 29 can be used to immobilize not only the specimen and/or a member of the specific binding pair but also one or more reagents which can serve as a positive or negative control. For a positive control, the membrane member 29 has a predetermined amount of the analyte(s) to be detected immobilized on a predetermined area or zone 29*b* of the membrane member 29. For a negative control, the membrane member 29 has a predetermined amount of a substance to which the analyte does not bind specifically immobilized on a predetermined area or zone 29*b* of the membrane member 29.

FIG. 6*a* shows a number of areas or zones 29*b* at which the appropriate substance to serve as a positive or negative control and other tests can be immobilized. The areas or zones 29*b* shown in FIG. 6*a* are presented for illustrative purposes only and, as will be understood by those skilled in the art, the size and configuration of the areas or zones 29*b* is a matter of design choice.

In a preferred embodiment as shown in FIG. 6*b*, the areas and zones 29*b* are configured as signs "+" and "−" and letters "Me", "Mu" and "Ru". These signs and letters represent the different substances bound on the areas and zones 29*b* of the membrane member 29, such as those used for positive and negative control, measles antigen, mumps antigen and rubella antigen as in an embodiment described hereinafter. Such signs and letters can directly reflect the assay reactions occurred at the areas and zones 29*b* and thereby make it easier for the user to identify or determine which analyte(s) (e.g., antibodies) are present in the specimen tested.

In another preferred embodiment as shown in FIG. 6*c*, the areas and zones 29*b* are configured as signs "+" and "−" and numbers such as "10", "50" and "100". Similar to those in the above embodiment, the signs are to represent the specific substances bound on the membrane member 29 which are used for positive and negative control. The numbers, on the other hand, are used to represent the amount of the same substance, such as an antigen, bound on the areas and zones 29*b* of the membrane member 29. Depending on the color change at these areas and zones 29*b* after the assay reaction, the numbers can assist in determining the amount of a specific analyte (e.g., antibody) in the specimen tested.

In addition, the number of areas or zones 29*b* depends upon the number of analytes to be assayed using the device. For example, as shown in FIG. 6*a*, the areas or zones 29*b* can have immobilized positive control reagents for 5 different assays. Alternatively, the zones or areas 29*b* can have immobilized one substance for a negative control and 4 positive control reagents. FIG. 6*a* is presented for illustrative purposes only and the determination of the size, number and configuration of the areas or zones 29*b* are well within the skill in the art.

Additionally, the membrane member 29 can be configured so that the portions of the membrane member 29 represented by the areas or zones 29*b* can be properly oriented in a predetermined orientation. In a preferred embodiment, a cut-out portion 29*a* (FIGS. 6*a* to 6*c*) can be provided on the membrane member 29 so that it can be properly oriented during manufacturing and assembling. Other orientating mechanism as can be contemplated by those skilled in the art can also be used.

The spring/latch assembly 30 (see FIG. 3*b*) has a spring member 32 and a latch member 34, both adapted to fit in the slot 26 on the specimen holder 20. The spring member 32 is disposed at the closed end of the slot 26 of the specimen holder 20 while the latch member 34 is arranged adjacent to the spring 32 and has a remote end 36 pointing outwardly. The remote end 36 engages a plunger member 47 during the operation of the assay device 1 as will be discussed later. The spring member 32 is preferably a compressed spring and kept in its compressed state before use.

Figure 3A:
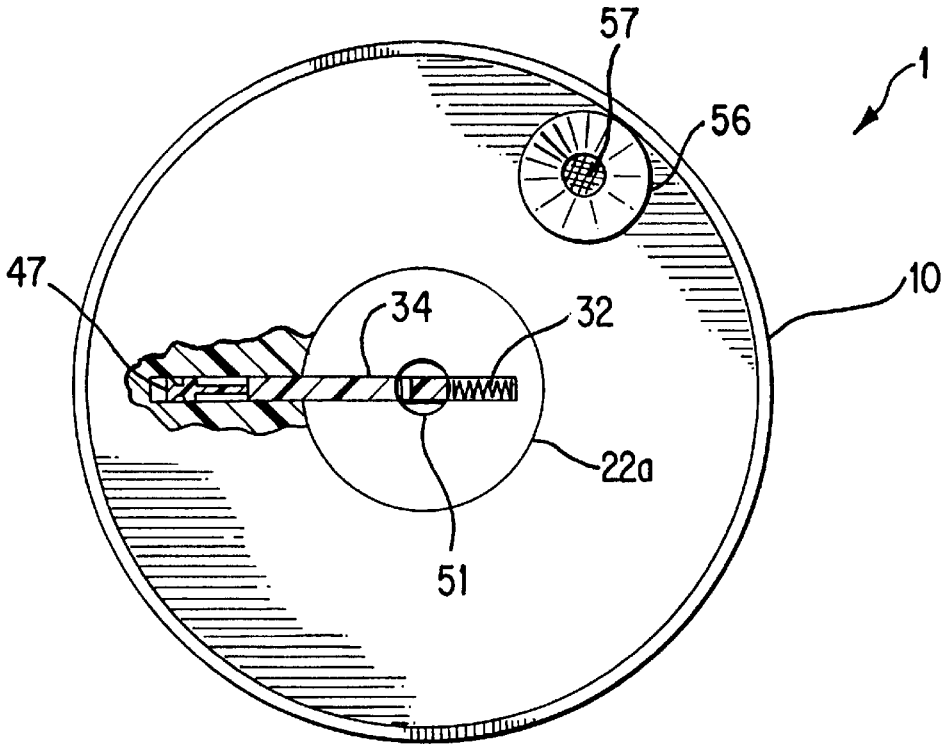
FIGS. 3*a* and 3*b* are a top view and a cross-section of an alternative preferred embodiment of the self-contained assay device according to the present invention.
Figure 3B:
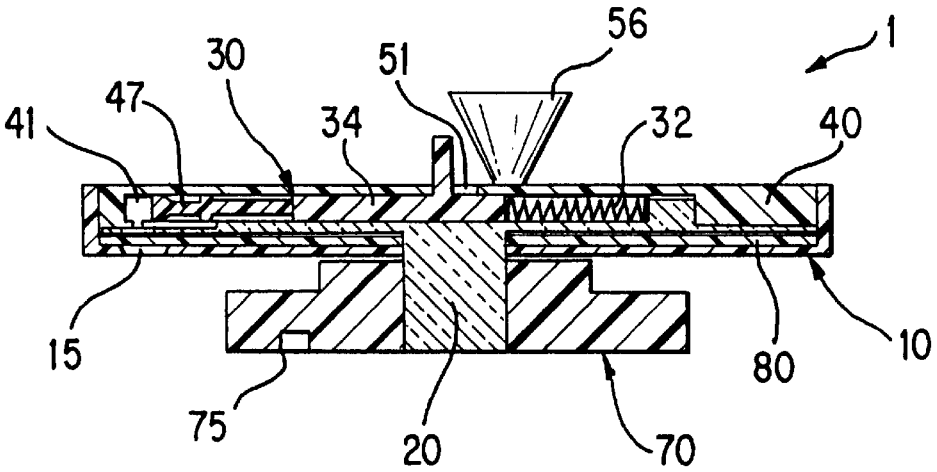
Figure 7A:
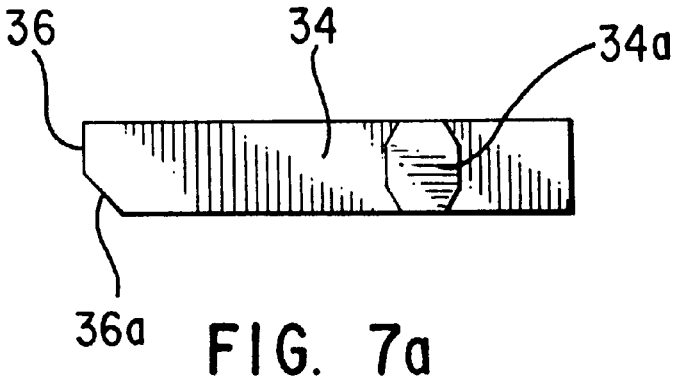
FIGS. 7*a* and 7*b* are top and side views of the ram member in the assay device in FIG. 3.
Figure 7B:
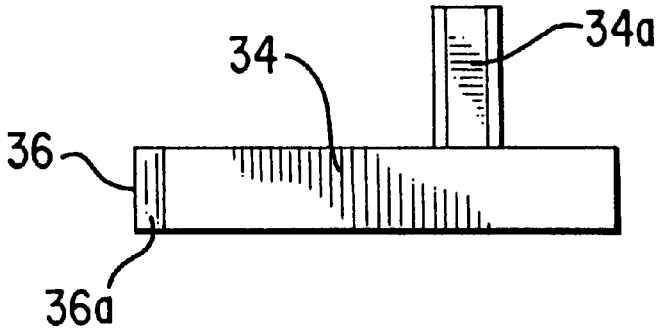

In an alternative embodiment as shown in FIGS. 3*a* and 3*b*, the latch member 34 has a traverse handle member 34*a* formed thereon, which is further illustrated in FIGS. 7*a* and 7*b*. After assembling, the handle member 34*a* extends out of the cam-plate 40 through a center hole 51 provided on the cam-plate 40, as shown in FIGS. 3*a* and 3*b*. When the spring/latch assembly 30 drives the plunger member 47 further into the bore member 41, the remote end 36 of the latch member 34 may also enter the bore member 41. Ir this case, the handle member 34*a* can be pulled to withdraw the remote end 36 of the latch member 34 back into the chamber 46. Thereby, a continuous operation of the self-contained assay device 1 can be performed. In addition, the remote end 36 of the latch member 34 can have a ramp portion 36*a* to assist its easy withdrawal to the chamber 46 and smooth advancement to the next chamber 46.

In an alternative embodiment, the center hole 51 is so sized that it can effectively limit the advancement of the handle member 34*a*. As a result, the remote end 36 of the latch member 34 is blocked from entering the bore member 41 by accident. Moreover, the handle member 34*a* can assist in withdrawing the spring/latch assembly 30 back to its compressed position. Thereby, the self-contained assay device 1 is prepared for the next test step. It is understood that this embodiment is preferred to be used for manual operation of the assay device 1.

The spring/latch assembly 30 also has a plurality of plunger members 47 retained partly in the inner bore member 41 of the cam-plate 40. Each plunger member 47 is adapted to be slidely fit in each bore member 41 and extend into the chamber 46 of the cam-plate 40. The plunger member 47 cooperates with the latch member 34 and the spring member 32 to dispense the reagent or wash solution 90 contained in the inner bore member 41 during the operation or the self-contained assay device 1.

Figure 8:
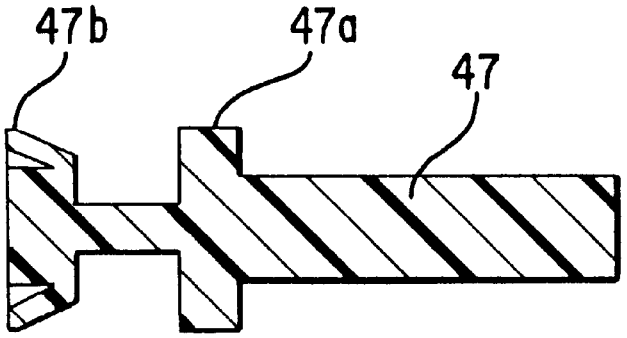
FIG. 8 is a cross-section of the plunger member in the self-contained assay device shown in FIG. 3.
Figure 9A:
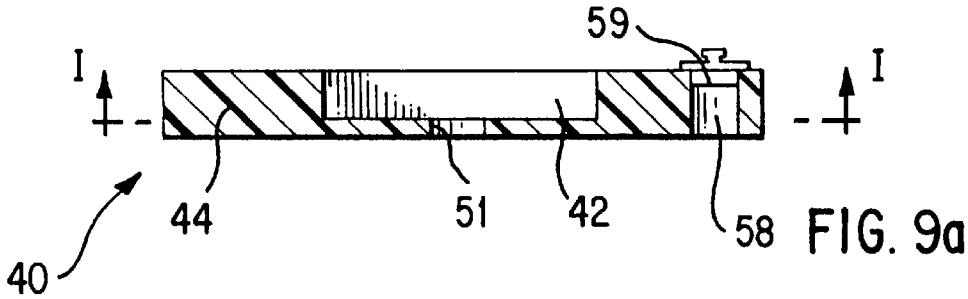
FIGS. 9*a*, 9*b*, 9*c* and 9*d* are cross-section, bottom view and partial enlarged views of the cam-plate in the assay device in FIG. 3.
Figure 9B:
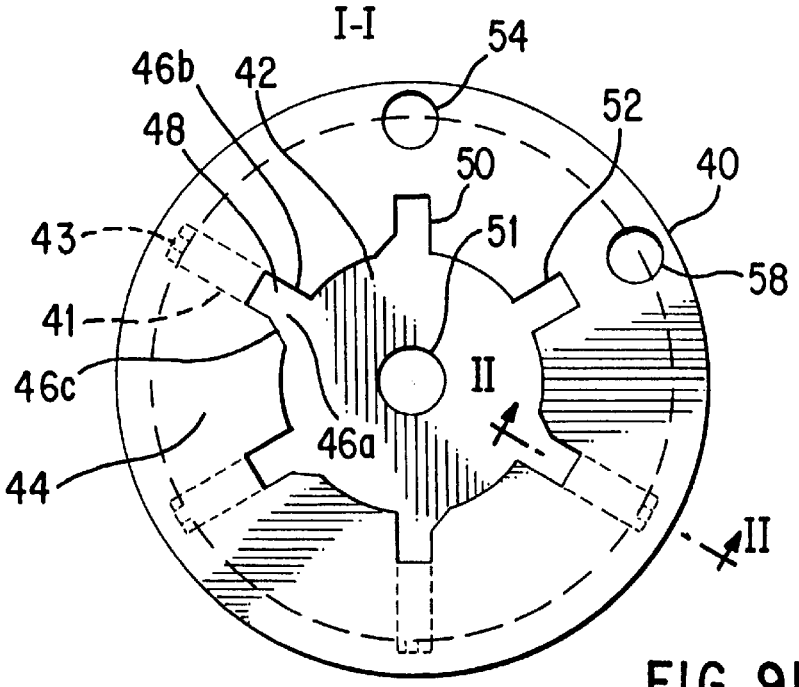
Figure 9C:
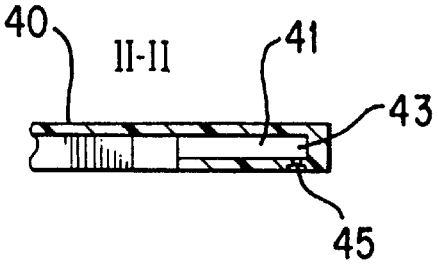
Figure 9D:
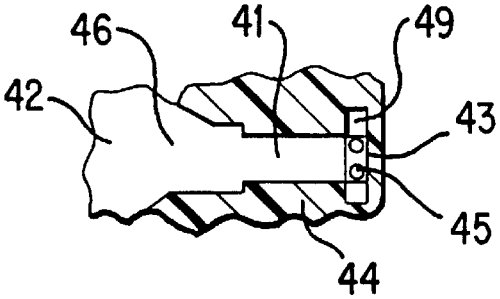

In a preferred embodiment as shown in FIG. 8, the plunger member 47 has a guiding shoulder 47*a* and a sealing end 47*b*. The guiding shoulder 47*a* is sized and adapted to slidely guide the plunger member 47 inside the bore member 41. Moreover, the sealing end 47*b* of the plunger member 47 is slidely fit inside the bore member 41 in a water-tight fashion. Thus, a predetermined quantity of reagent (or wash solution) can be sealed in the bore member 41 between the dead end 43 and the sealing end 47*b* of the plunger member 47.

FIGS. 9*a* through 9*d* show various details of the second housing 40, preferably a cam-plate. The cam-plate 40 is configured as a circular disk made of plastic material, such as clear acrylic, etc. The peripheral of the cam-plate 40 is dimensioned to be tightly fit in the upstanding circular wall 14 of the first housing 10. There is a concave portion 42 formed on the underside of the cam-plate 40 which is surrounded by a rim portion 44 of the cam-plate 40. The concave portion 42 is adapted to accommodate the center portion 22*a* of the specimen holder 20 while the rim portion 44 is supported on the circular flange 22*b* of the specimen holder 20. In this manner, the cam-plate 40 can lay on the specimen holder 20 when assembled.

A plurality of chambers 46 are provided on the rim portion 44 of the cam-plate 40 and in communication with the concave portion 42. Each chamber 46 has a triangular shaped portion with its bottom portion 46*a* merging into the concave portion 42. The other two sides 46*b* and 46*c* of each chamber 46 extend so that they would meet at an apex 48 portion, which is close to the peripheral portion of the cam-plate 40.

One of the two sides 46*b* and 46*c* is a radial side 46*b* extending substantially radially and the other side 46*c* is a cam side. Preferably, at least part of the cam side 46*c* of each chamber 46 is curved to facilitate the operation of the assay device 1 as will be discussed later. The radial sides 46*b* alternate with the cam sides 46*c* along the peripheral of the concave portion 42 of the chambers 46.

In addition, each chamber 46 has an inner bore member 41 provided in its rim portion 44. Each inner bore member 41 communicates with its corresponding chamber 46 at the apex portion 48 and extends radially outwardly to reach its dead end 43. Each inner bore members 41 slidely engages with at least part of a plunger member 47 and thus holds the same therein. The inner bore member 41 and the plunger member 47 retain a reagent (or wash solution) 90 at the dead end 43 of the inner bore member 41 when sealingly engaging with each other.

Preferably, the inner bore member 41 has a length which is substantially the same as or, preferably, slightly shorter than that of the plunger member 47. Thus, after the plunger member 47 thrusts into the bore member 41 to dispense the reagent (or wash solution) 90, it can still extend to the apex portion 48 of the chamber 46. In this manner, the plunger member 47 can facilitate a smooth transition from the apex portion 48 to the cam side 46*c* of the chamber 46. Thus, the remote end 36 on the latch member 34 can move from the apex portion 48 toward the next chamber 46, so that the assay device 1 can be readily rotated for the next reaction.

Figure 2A:
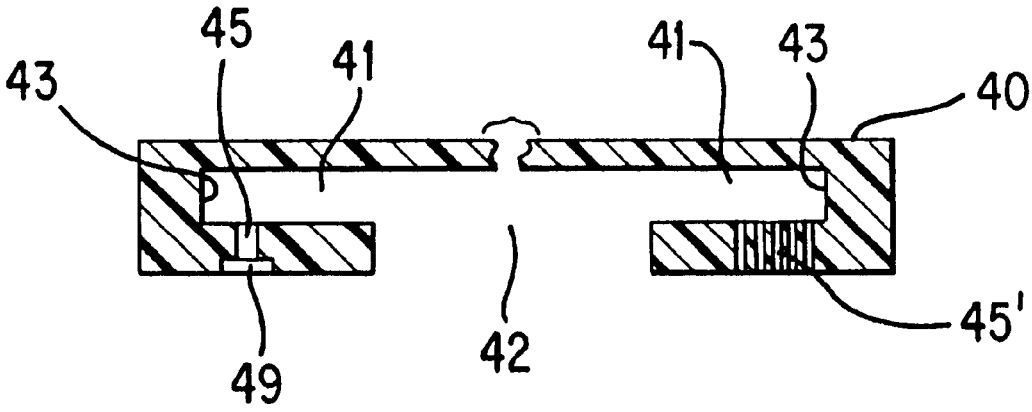
FIGS. 2*a* and 2*b* are partial enlarged views of the self-contained assay device in FIGS. 1*a* and 1*b;*
Figure 2B:
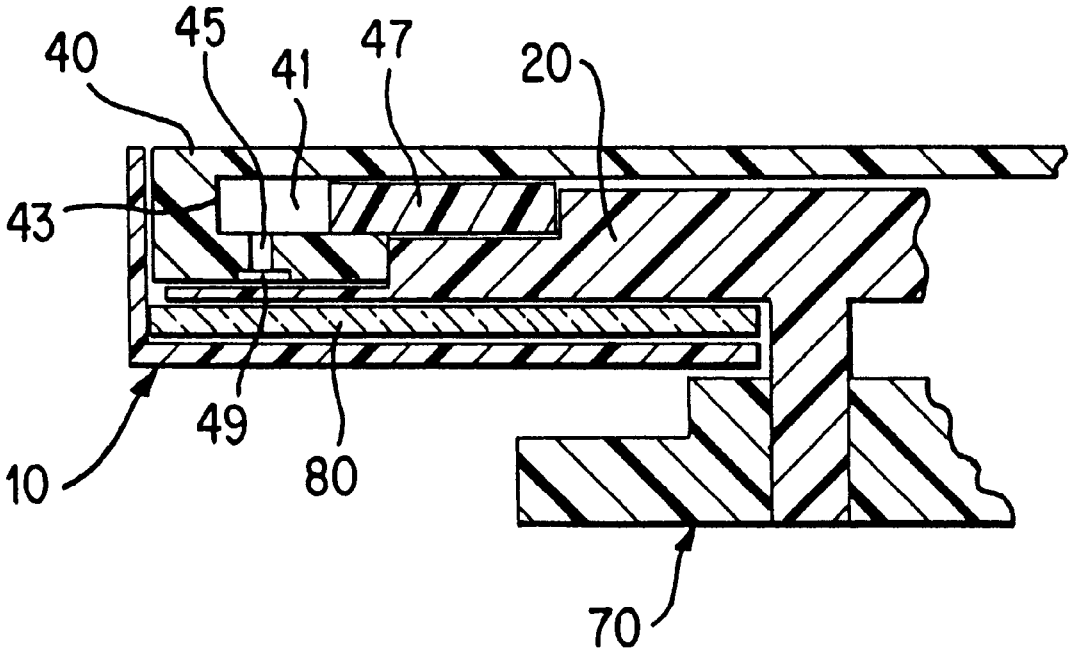

An outlet 45 is provided at the lower portion of each inner bore member 41. Thereby, the reagent 90 can flow therethrough and onto the specimen holder 20 or the membrane member 29 fixed thereto to react with the specimen to be tested. Preferably, the outlet 45 is located adjacent to the dead end 43 of each inner bore member 41 so that the reagent contained in the inner bore member 41 can all be dispensed. In a preferred embodiment, the outlet 45 can have an enlarged lower portion 49, as shown in FIGS. 2*a* and 2*b*. The enlarged lower portion 49 can prevent capillary action from permitting the premature release of reagent 90, the added specimen or the resultant of the reaction of the two to migrate out of the outlet 45.

In an alternative embodiment shown in FIG. 2*a*, the outlet 45 is configured as a plurality of fine through holes 45'. In this manner, the reagent 90 can be forced to spray out of the fine outlet holes 45' and be evenly distributed onto the specimen holder 20 or the membrane member 29 to thereby ensure a thorough reaction with the specimen. Similar to the above preferred embodiment, each fine hole 45' can be enlarged at its lower portion to prevent capillary action as discussed above.

It is preferred that the cam-shaped chambers 46 are continuously and evenly distributed along, at least a portion of, the peripheral of the concave portion 42. The number of chambers 46 for the self-contained assay device 1 can be up to 6 or more depending on analysis requirements. In a preferred embodiment shown in FIG. 1*a*, four chambers 46 are provided. These chambers 46 are continuously arranged along the peripheral of the concave portion 42 to occupy about 240° arc thereof. The apex portion 48 of two adjacent chambers 46 are spaced from each for about 60° arc of the peripheral of the concave portion 42.

It is also preferred that at least a portion of the periphery of the rim portion 44 is free of any cam-shaped chamber 46 and therefore a retaining mechanism can be provided thereon. As shown in FIG. 1*a*, a nitch member 50 and a slot member 52 are provided along the periphery of the concave portion 42 and in the rim portion 44. As will be described in detail hereinafter, the nitch member 50 and the slot member 52 are adapted to retain the latch member 34 of the spring/latch assembly 30 in position at the start and the end of the operation of the assay device 1 respectively. The nitch member 50 is located next to a radial side 46*b* of the first chamber 46. The slot member 52 is located next to the cam side 46*c* of the last chamber 46. In a preferred embodiment, the nitch member 50, the slot member 52 and the cam-shaped chambers 46 are all evenly distributed along the peripheral of the concave portion 42.

The cam-plate 40 also has an opening 54 located on its rim portion 44, through which a specimen to be tested is introduced into the self-contained assay device 1. The opening 54 is preferably aligned with the start position of the assay device 1, as shown in FIG. 1*a*. It is also preferred that the opening 54 and the chambers 46 are evenly distributed along the peripheral of the concave portion 42. In a preferred embodiment shown in FIG. 1*a*, the opening 54 is in the form of a through hole. The arc between the through hole 54 and its adjacent chamber 46 is also 60°. The through hole 54 and the nitch member 50 are substantially in the same radial direction. The through hole 54 is also adapted to receive a receptacle 56 (FIG. 1*b*) therein.

A filter member 57 as shown in FIGS. 1*a* and 3*a* can be provided with the assay device 1 to filter particulates such as erythrocytes, aggregates, crystals, etc. from the specimen. In an embodiment as shown in FIG. 1*a*, the filter member 57 is affixed to the opening 54 on the cam-plate 40. In an alternative embodiment as shown in FIG. 3*a*, the filter member 57 is designed to be assembled in the receptacle 56. When a specimen is added into the assay device 1 through either the opening 54 on the cam-plate 40 of the receptacle 56, the filter member 57 can remove debris or the like from the specimen.

The cam-plate 40 can further have an observation port 58 (FIG. 9*a*) located on its rim portion 44. The observation port 58 is preferably spaced away from the center cam-plate 40 for such a distance that it can be aligned with the position 28 on the specimen holder 20. Further, the observation port 58 and the slot member 52 on the cam-plate 40 are substantially in the same radial direction. In a preferred embodiment shown in FIG. 1*a*, the arc between the observation port 58 and its adjacent chamber 46 is also 60°. The observation port 58 can be in the form of a through hole. A removable cover 59 can be provided to fit in and from the top of the observation port 58 to seal the same.

Figure 10A:
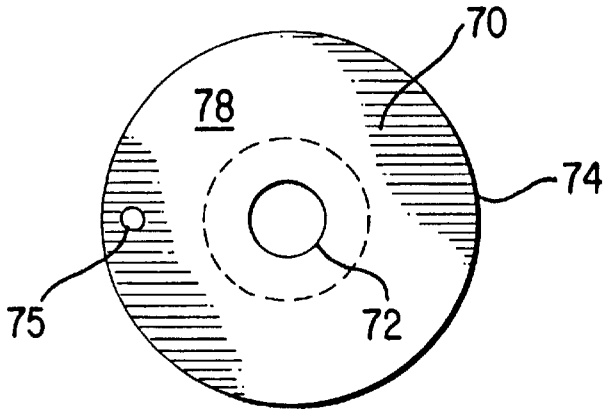
FIGS. 10*a* and 10*b* are top and side views of the knob member in the assay device in FIGS. 1 and 3.
Figure 10B:
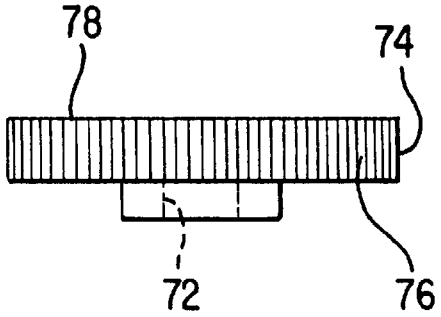

FIGS. 10*a* and 10*b* show a knob member 70, which is provided to facilitate the rotation between the specimen holder 20 and the cam-plate 40. The knob member 70 has a through hole 72 therein for engaging with the pin member 24 on the specimen holder 20. The peripheral 74 of the knob member 70 provides the user with grip mechanism in operating the assay device 1. In a preferred embodiment, the peripheral 74 has straight knurls 76 thereon for assisting the user in gripping the knob member 70. Alternatively, the peripheral 74 of the knob member 70 can be scalloped. The configuration of the peripheral 74 of the knob member 70 can be various shapes, such as a circle, triangle, rectangle, pentagon and hexagon. The knob member 70 can also have an irregular shaped peripheral 74 so long as the peripheral 74 can provide a grip mechanism.

It is preferred that the knob member 70 has a flat bottom 78 so that, when it is attached to the axal 24 on the specimen holder 20, the entire assay device 1 can sit on a flat supporting surface.

In addition, the knob member 70 can have an orientating device 75, which is located on its bottom 78 preferably. Similar to the orientating device 15 on the first housing 10, the orientating device 75 is adapted to engage with a complemental orientating device on an automatic operating apparatus to thus ensure the knob member 70 is properly positioned in the operating apparatus for automated operation as will be described later. In a preferred embodiment, the orientating device 75 on the knob member 70 is in the form of a recess member, which is engagable with a key member on the operating apparatus.

Figure 11:
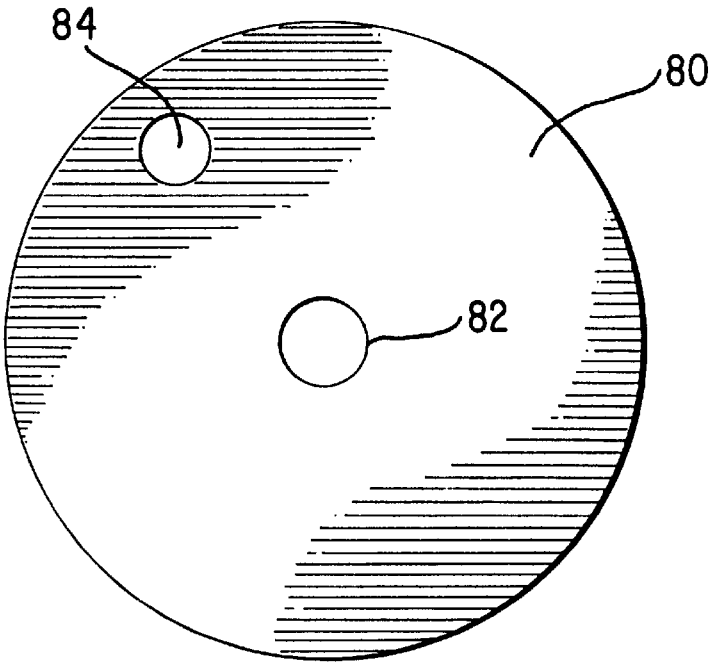
FIG. 11 is a top view of the blotter member in the self-contained assay device in FIGS. 1 and 3.
Figure 12A:
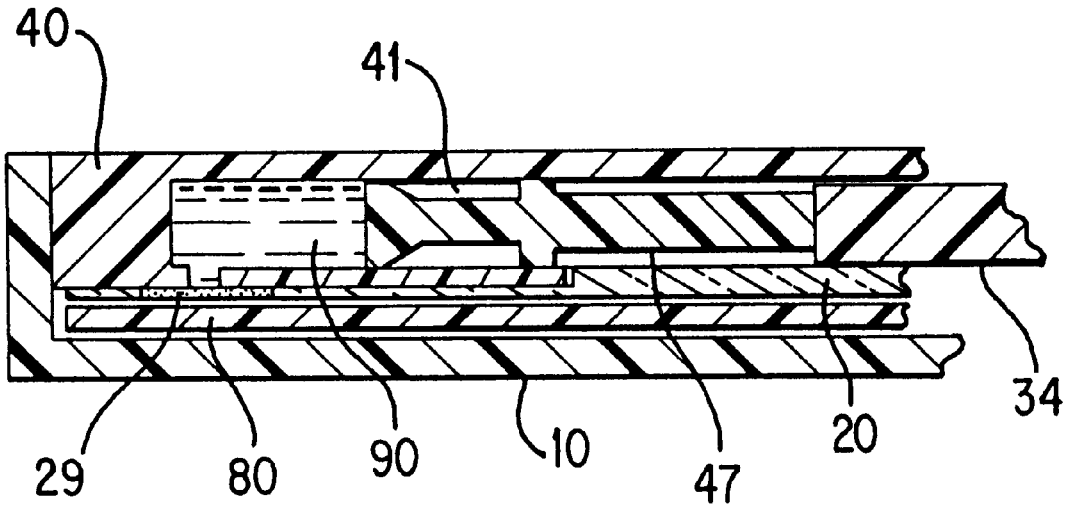
FIGS. 12*a* and 12*b* are partial enlarged views of the self-contained assay device in FIGS. 3*a* and 3*b* showing the loaded position and the dispensed position respectively.
Figure 12B:
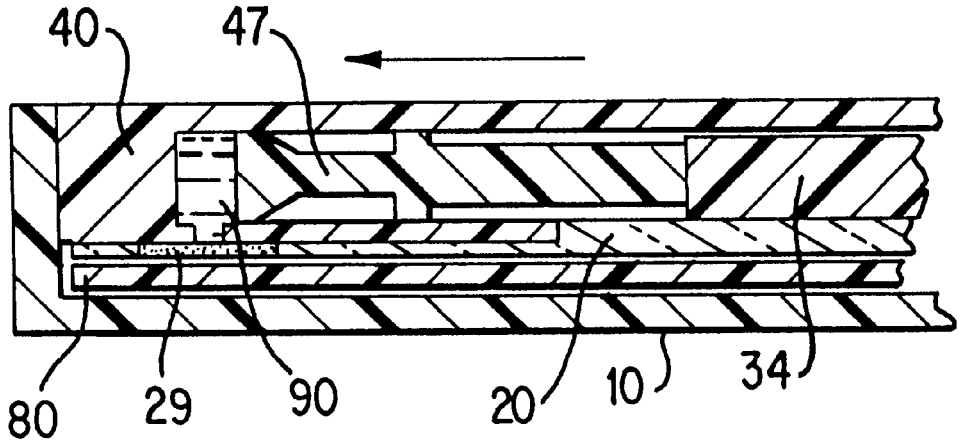

FIG. 11 shows a blotter member 80 which can be used in the self-contained assay device 1. The blotter member 80 has a circular shape dimensioned to be tightly fit in the upstanding wall 14 of the first housing 10. The blotter member 80 has a center aperture 82 designed to pass the pin member 24 of the specimen holder 20 therethrough. Thereby, the blotter member 80 can be held between the first housing and the specimen holder 20 when the assay device 1 is assembled. One main function for the blotter member 80 is to absorb excess liquid or any liquid that may enter into the first housing 10 and to prevent the same from leaking out of the self-contained assay device 1.

Further, the blotter member 80 can have a through hole 84 as shown in FIG. 11. The through hole 34 is located near the periphery of the blotter member 80 and away from the center of the blotter member 80 for a distance. Such a distance is substantially the same to that the position 28 is away from the center of the specimen holder 20. Thereby, as the assay device 1 is rotated to its end position, the through hole 84 on the blotter member 80 can be aligned with the position 28 for observation purpose. The construction of such through hole 84 is particularly applicable for the case where the first and second housings 10 and 40 and the specimen holder 20 are made of non-transparent materials. When being used, such blotter member 80 is made aligned with the slot member 52 on the cam-plate 40 and is preferably fixed to the first housing 10.

When assembled, the blotter member 80, the specimen holder 20, the spring/latch assembly 30 and the cam-plate 40 are all accommodated in the first housing 10 with the cam-plate 40 being fixedly fit within the first housing 10. The specimen holder 20 is rotatable relative to the cam-plate 40 but retained in a start position through the engagement between the latch remote end 36 and the nitch member 50 on the cam-plate 40. The spring member 32 of the spring/latch assembly 30 is thus maintained in a compressed position. In case that the housings 10 and 40 and the specimen holder 20 are made of non-transparent materials, the observation port 58 on the cam-plate 40 is aligned with the through hole 84 on the blotter member 80. Fluids 90 comprising various reagent(s) and/or wash solution(s) for the test analysis or analyses are placed and retained at the dead end 43 of each inner bore member 41 of the chamber 46. The receptacle 60 can be attached to the opening 54 on the cam-plate 40 for receiving a specimen to be tested in the assay device 1.

Descriptions will now be made in relation to the operation of the self-contained assay device 1 of the present invention. A sufficient volume of a specimen to be tested is introduced into the assay device 1 through the opening 54 on the cam-plate 40 so that it covers completely or wets the position 28 on the specimen holder 20 or the membrane member 29. In a preferred embodiment, the specimen is sprayed into the assay device 1 and thus is evenly distributed on the circular flange 22*b* of the specimen holder 20 at position 28. In other words, the added specimen is deposited on the membrane member 29. The specimen holder 20 is then rotated relative to the cam-plate 40 so that the latch remote end 36 of the spring/latch assembly 30, as well as position 28 on the specimen holder 20, leaves the start position and moves toward the first chamber 46. During such rotation, the spring member 32 of the spring/latch assembly 30 is maintained in a compressed state by the peripheral of the concave portion 42 of the cam-plate 40.

When the latch remote end 36 arrives at the apex portion 48 of the first chamber 46*a*, the compressed spring 32 is released from the restriction of the peripheral of the concave portion 42. The latch member 34 thus thrusts radially outwardly and into the first chamber 46 to engage the first plunger member 47 and drive the same further into the inner bore member 41. The reagent (or wash solution) 90 contained at the dead end 43 of the inner bore member 41 is thus dispensed through the outlet 45 onto the circular flange 22*b* of the specimen holder 20 at position 28 where the member 29 is attached. The reagent can thus react with the specimen added onto membrane member 29 in advance.

After the reaction, unbound specimen or reagent can pass through the membrane member 29, and the porous position 28 on the circular flange 22*b* and deposit on the blotter member 80. The bound specimen or reagent, on the other hand, is immobilized by the membrane member 29 on the specimen holder 20 for a subsequent assay reaction.

In an alternative embodiment, the unbound specimen or reagent can be carried away by the first chamber 46*a* upon further rotation of the assay device 1 to the next reaction position. When the rim portion 44 and the circular flange 22*b* are water-tightly engaged. When the rim portion 44 and the circular flange 22*b* do not have a water-tight engagement, unbound specimen or reagent can flow therebetween and onto the blotter member 80. The bound specimen or reagent, on the other hand, is immobilized by the membrane member 29 on the specimen holder 20 for a subsequent assay reaction.

The specimen holder 20 is then rotated again relative to the cam-plate 40 so that the latch remote end 36 of the spring/latch assembly 30 and position 28 on the specimen holder 20 leave the apex portion 48 of the first chamber 46*a* and move along the cam side 46*c* toward the second chamber 46*b*. As the specimen holder 20 is being rotated, the cam side 46*c* of the first chamber 46*a* pushes the latch member 34 and, in turn, the spring member 32 of the spring/latch assembly 30 back into the slot 26 on the specimen holder 20 and in a compressed state. The spring member 32 of the spring/latch assembly 30 is thus ready for the next thrust. After the spring/latch assembly 30 is forced back into the slot 26, the result of the reaction can be easily observed through the transparent cam-plate 40.

The above steps are then repeated until the latch remote end 36 of the spring/latch assembly 30 passes all the cam-shaped chambers 46 and comes to the end position to engage with the slot member 52. Thereby, the result of a previous reaction is made to react with the reagent and/or wash solution 90 contained in the inner bore member 41 of a next chamber 46. In this way, the specimen is carried through a series of reactions in an analysis for detecting analyte(s) contained therein. The final result of the test can be easily observed through the transparent cam-plate 40. After the completion of the test, the self-contained assay device 1 can be discarded and no cleaning step is necessary.

In an alternative embodiment where the housings 10 and 40 and the specimen holder 20 are not transparent, observation of the final result can be made through the observation port 58 on the cam-plate 40 and/or the through holes 18 and 84 (FIG. 4*a* and 11) in the first housing 10 and the blotter member 80 respectively, when the cover 59 is removed. The cover 59 can be replaced before the assay device 1 is discarded.

In a preferred embodiment, one or more inner bore members 41 containing a wash solution is used in the self-contained assay device 1. Such wash solutions 90' are arranged similarly in the inner bore members 41 of desired cam-shaped chambers 46. In another preferred embodiment, wash solution 90' is arranged alternately with the reagent 90. Thereby, after each reaction of the reagent. 90 and the specimen, a wash solution 90' is dispensed to wash away any unbound specimen or reagent. In this way, only the bound resultant is left at position 28 or the membrane member 29 on the specimen holder 20, which is to be used for the next reaction with the reagent 90 in the inner bore member 41 of the next chamber 46. A reagent or wash solution may be the fluid contained in the first inner bore member. In a preferred embodiment, a wash solution is contained in the first inner bore member.

In an alternative embodiment, the operation of the self-contained assay device 1 is automated. Accordingly, an operating apparatus (not shown) is employed, which can be any conventional apparatus for conducting a similar operation. A typical operating apparatus can have a first and a second clamping members for holding the first housing 10 and the knob member 70 of the assay device 1 respectively. The first and second clamping members are rotatable relative to each other through a step motor to conduct the test. In a preferred embodiment, the first and second clamping members each include an orientating device engagable with the orientating devices 15 and 75 on the assay device 1. The orienting devices on the clamping members can be in the form of recesses or preferably keys complementary to the keys and recesses 15 and 75 on the assay device 1. In this manner, the assay device 1 can be properly orientated in the operating apparatus for the benefit of utilizing a reader, such as a bar code reader, for automatic analysis.

The operating apparatus can also have a computer device for electronically controlling the testing operation. The computer device is programmed so that it can control the temperature and the time period for each reaction in the assay device 1. In addition, the operating apparatus can have an automatic reader to identify various test resultants retained on the membrane member 29. The automatic reader can be of various forms such as a bar code scanner or other types of color reaction detectors. The automatic reader can be linked to a computer or other device to automatically record and store the results of the tests conducted using the assay device, e.g., for medical records keeping.

When using the assay device 1 of the present invention on the operating apparatus to conduct a test, the first housing 10 and the knob member 70 of the assay device 1 are held by the first and second clamping members of the apparatus respectively. In a preferred embodiment, the orientating devices on the assay device 1 and those on the operating apparatus are made to engage with one another. Thereby, the automatic bar code reader can align with the end position or the observation port 58 of the assay device 1 for automatic assay and analysis.

After the assay device 1 is properly oriented and held in the operating machine, a step motor then rotates one of the first housing 10 and the knob member 70 step by step so that the spring/latch assembly 30 moves from one chamber 46*b* to a next chamber 46*b* in each rotation. For each test, the step motor only moves a predetermined number of steps, depending on the number of steps of a particular test or the number of chambers 46*b* of the assay device 1. Upon completion of all the rotation steps, the step motor stops so that the user can exam the test results. When the test finishes, the operating machine releases the assay device 1 or disposes the assay device 1 as desired.

The assay device of the present invention is useful to determine the presence (or absence) of an analyte in a sample or specimen suspected of containing the analyte. Any type of specimen or sample in fluid form can be used, including but not limited to biological samples such as blood, serum, plasma, milk, urine, sweat, saliva, cerebrospinal fluid, amniotic fluid, semen, vaginal and cervical secretions, bronchial secretions, intestinal fluid, wound fluid (exudates and transudates), thoracentesis fluid, cell or tissue suspensions, etc., environmental samples such as water samples, soil suspensions, etc.

As used according to the present invention, an analyte is intended to mean any compound or composition to be assessed which is a member of a specific binding pair and may be a ligand or a receptor. A member of a specific binding pair is one of two different compounds or compositions, having an area, either on the surface or in a cavity, which specifically binds to and is thereby defined as complementary with a particular spatial and polar organization of the other compound or composition. The members of a specific binding pair are generally referred to as "ligand" and "receptor" ("anti-ligand").

As used herein, a ligand includes any compound or composition for which a receptor naturally exists or can be prepared. Illustrative ligands include but are not limited to antigens; hormones; pheromones; signal substances such as neurotransmitters, signal proteins and peptides, etc.; enzyme substrates and cofactors; ligands for receptor proteins; nucleic acids and polynucleotides; biotin; lectins; growth factors or cytokines; drugs; toxins; etc.

As used herein, a receptor (anti-ligand) includes any compound or composition which recognizes a particular spatial and polar organization of a compound or composition, e.g., an epitopic or determinant site or a complementary binding site. Illustrative receptors include but are not limited to immunoglobulins or antibodies or antigen binding portions thereof such as Fv, $F(ab')_2$, Fab fragments, single chain antibodies, chimeric or humanized antibodies, complementary determining regions of antibodies; hormone receptors; pheromone receptors; signal substance receptors; enzymes; protein receptors; nucleic acids and polynucleotides; avidin or streptavidin; lectin binding proteins; growth factor or cytokine receptors; drug receptors; etc. As will be understood easily by those skilled in the art, nucleic acids, polynucleotides and oligonucleotides which are complementary to one another can serve as the two members of a specific binding pair which can be used in the assay devices of the present invention, one serving as ligand and the other serving as receptor or anti-ligand.

When the analyte to be detected is an antigen associated with an infectious agent such as a bacterium, fungus, virus, mycoplasma or other parasite, the assay device of the invention can be used for the detection of infectious disease in a patient from which the sample or specimen is obtained. When the analyte to be detected is an antibody against an antigen associated with an infectious agent, the assay device of the invention can be used to detect the presence of immunity to an infectious disease in the patient from whom the specimen is obtained. In this instance, the signal detected can be compared to a standard provided, and immunity is assessed by comparison to appropriate signal, e.g., color developed, indicating at least a minimum antibody titer present. In one embodiment, the standard can be provided as appropriate zone(s) 29*b* (see FIGS. 6*a*–6*c*) on the membrane member. The two above-described uses of the present device are only illustrative examples. Numerous other uses for the assay devices of the invention will occur to those skilled in the art depending upon the analyte to be detected, including but not limited to detection of the presence or absence of particular types of cancer, genetic mutations or defects, metabolic imbalances, drugs, toxins, pesticides, etc. and are all within the scope of the applications or methods for using the present invention.

The reagents and/or wash solutions, optionally including an ancillary material such as a buffer, stabilizer, additive to enhance binding, etc., contained in the assay device 1 as well as the amount of reagent retained in the inner bore member 41 of the assay device 1 will depend upon the analyte to be detected and is readily known to those skilled in the art.

In all instances, there is at least one reagent 90 which is complementary to and binds specifically to the analyte(one member of a specific binding pair) which is to be tested for in the assay, i.e., the other member of the specific binding pair.

In all instances, there is provided at least one or more of the reagents which provides a signal system, such as a color change, which indicates the presence or the analyte in the specimen being tested. One reagent which is a member of the specific binding pair which binds specifically to the analyte, i.e., second specific binding pair member, or another molecule which binds specifically to the second binding pair member is labelled to provide a signal system. Suitable signal systems employ the use of an enzyme label, a fluorescent label, a chemiluminescent label or enhanced chemiluminescent label, or a radioactive label, etc. Non-radioactive labels are preferred. Suitable signal systems are well-known to those skilled in the art. See, for example, David Wild, ed., The Immunoassay Handbook, Stockton Press, 1994, particularly at pages 63–77 (incorporated herein by reference) for suitable labels and signal generation systems useful when the specific binding pair members are antigen and antibody (or binding portion thereof). See, for example, George H. Keller et al., DNA Probes, Stockton Press, 1989, particularly at pages 71–148 (incorporated by reference herein) for suitable labels and signal generation systems when the specific binding pair members are complementary polynucleotides.

Preferred are signal systems in which a change, such as in color, indicating the presence of analyte in a specimen can be detected visually by the naked eye of the person using the assay device under normal ambient conditions. Alternatively, signal systems in which a change indicating the presence of analyte in a specimen can be detected using the naked eye of the person using the assay device aided by, for example, light of a particular wavelength, e.g., ultraviolet light, etc. or which can be detected using spectrophotometric or other instrumental detection systems can be used. Less preferred is a signal system using a radioactive label; in such instance an appropriate device for detecting emitted radiation is used.

As one illustrative example, when the analyte to be detected is an antigen suspected of being present in a patient specimen, the reagents retained in the assay device 1 can include a capture anti-antigen antibody bound to the reaction membrane member, a second anti-antigen antibody that recognizes a different epitope from that recognized by the capture antibody labelled, e.g. with an enzyme such as horseradish peroxidase; a wash solution, and a substrate for the enzyme label, e.g., 2,2'-azino-bis (ethylbenzothiazoline-6-sulfonate) (ABTS), D-phenylenediamine (OPD) or (3,3', 5,5'tetramethyl benzidine (TMB) (all peroxidase substrates). Alternatively, the reagents for such assay can include a capture antibody, an anti-antigen antibody; a wash solution; an anti-antibody labelled e.g., with an enzyme; a wash solution and a substrate for the enzyme label.

As another illustrative example, when the analyte to be detected is an antibody suspected of being present in a patient specimen, the reagents retained in the assay device 1 can include an antigen to which the suspected antibody binds specifically bound to the reaction membrane member; a wash solution; anti-immunoglobulin, e.g., human immunoglobulin, antibody labelled e.g., with an enzyme label; a wash solution; and a substrate for the enzyme label which when reacted with the enzyme provides a detectable color change indicating presence of the analyte.

According to an embodiment of the present invention, illustrated in FIG. 6*a* a predetermined amount of the analyte to be detected is immobilized on a predetermined portion of the membrane member 29, i.e., 29*b*, provided on the circular flange 22*b* of the specimen holder 20 at position 28. The predetermined amount of immobilized analyte reacts with all the reagents 90 and affords a positive analyte control that provides a positive control signal indicating that the reagents are functioning properly and assuring the user of the device that the assay has been successfully conducted.

The following illustrative example describes a method for detecting an analyte which is an antigen, e.g. a hepatitis A antigen, suspected of being present in a patient using the self-contained assay device of the present invention. The example is for illustrative purposes only and is in no way intended to limit the scope of the methods of the invention or the appended claims. As will be appreciated by those skilled in the art, the methods for using the self-contained assay device can be modified or changed for use to assay for numerous other analytes and all such modifications or changes may be practiced and are encompassed within the scope of the appended claims.

As an example, the method for detecting hepatitis antigen comprises: introducing a predetermined quantity of a specimen which is a patient blood sample into the self-contained assay device 1 of the present invention through the opening 54 on the cam-plate 40 which contains a filter member 57 for removing particulates, said assay device having a number of reagents immobilized onto separate portions of the membrane member 29, i.e., 29*b*, positioned on the specimen holder 20 onto which the blood sample is introduced. The membrane member 29 at specific areas and zones 29*b* has immobilized thereon the following substances: hepatitis A viral antigen (positive control), unrelated protein such as gelatin (negative control), anti-hepatitis A antibody (capture antibody), anti-hepatitis C antibody and anti-hepatitis B antibody respectively; rotating the specimen holder 20 relative to the cam-plate 40 to move the latch member 34 and the spring member 32 of the spring/latch assembly 30 from a start position toward a first chamber 46 till the latch remote end 36 reaches the apex portion 48 of the first chamber so that the latch member 34 drives a plunger member 47 to dispense a wash solution to wash away any unbound material; rotating the specimen holder 20 relative to the cam-plate 40 to move the spring/latch assembly 30 to the next chamber 46 to dispense a reagent 90 containing an anti-hepatitis A antibody that recognizes an epitope different from the one recognized by the capture antibody, labelled with an enzyme label; permitting the released antibody to contact the specimen on the membrane member for a sufficient time so that any antigen present can bind to the enzyme labelled antibody; rotating the specimen holder 20 relative to the cam-plate 40 to move the latch member 34 and the spring member 32 of the spring/latch assembly 30 to the next chamber 46 to dispense a reagent 90 retained therein releasing a wash solution; repeating the above step till the latch remote end 36 of the spring/latch assembly 30 reaches the next chamber 46 and dispenses a reagent 90 retained therein releasing a substrate for the enzyme (label) and permitting reaction to occur between any enzyme labelled antibody bound to the specimen holder 20 and the enzyme substrate to provide a color change indicative of the presence of antigen; and rotating the specimen holder 20 relative to the cam-plate 40 to move the latch member 34 and the spring member 32 of the spring/latch assembly 30 from the last chamber 46 to an end position; and observing the results, comparing the color signal developed on the portion of the membrane member 29 to which the specimen was applied with that of the portion of the membrane member 29*b* on which hepatitis A was immobilized as a positive control to determine whether hepatitis A is present in the patient sample.

In another embodiment, the self-contained assay device 1 can be used to detect the presence of more than one analyte in a sample. In a preferred mode of this embodiment of the invention, the assay device 1 can be usied to detect the presence of a number of antibodies to a number of infectious agents to assess whether a patient has sufficient immunity to each of the various infectious agents.

As an illustrative example, the assay device 1 can be used to detect antibodies against a panel of viral agents, e.g., measles, mumps and rubella, etc. in order to assess the status of vaccination against each such virus. A sufficient amount of specimen is applied to wet or to cover the membrane member 29. The membrane member 29 at specific areas or zones 29*b* contains the following substances: human serum immunoglobulins (positive control), gelatin, an unrelated protein (negative control), measles antigen, mumps antigen, and rubella antigen, respectively. As will be understood by those skilled in the art, the position and/or configuration of each of the positive and negative controls and of each of the antigens on the membrane member is identified to help easily determine which one or more antibodies is/are present in the specimen. See, for example, FIGS. 6*a*–6*c*. The specimen is permitted to contact the membrane member 29 for a time sufficient for any antibody in the specimen to bind to the immobilized antigen(s). The first chamber 46 retains wash solution to wash away any unbound antibody. The next chamber 46 retains anti-human immunoglobulin labelled with an enzyme label. The next chamber 46 retains a wash solution to wash away any unbound labelled antibody. The next chamber 46 retains enzyme substrate, which provides a color change when reacted with enzyme (labelled antibody). Thus, when the assay is completed, visualization of the results is easily provided to determine the presence or absence of each of measles, mumps and rubella antibodies in the patient specimen.

The foregoing description is only illustrative of the principle of the present invention. It is to be recognized and understood that the invention is not to be limited to the exact configuration as illustrated and described herein. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. A self-contained assay device for detecting analyte(s) in a specimen comprising:

(a) a first housing having a bottom with a center hole;

(b) a specimen holder rotatably fit in the first housing the specimen holder including a center portion having a center and a periphery, a circular flange surrounding the center portion adapted and configured to retain the specimen to be tested and a pin member extending from the specimen holder and disposed within the center hole of the housing, the center portion having a radial slot extending from its periphery toward its center;

(c) a spring/latch assembly adapted to be fit in the radial slot of the specimen holder, the spring/latch assembly including a spring member disposed near the center of the center portion and a latch member having a remote end;

(d) a second housing adapted to be fixedly fit in the first housing, the second housing comprising:

a concave portion adapted to accommodate the center portion of the specimen holder, a rim portion surrounding the concave portion;

an opening in the rim portion for adding the specimen to be tested, the opening in communication with the circular flange;

a plurality of cam-shaped chambers provided in the rim portion and communicating with the concave portion, each cam-shaped chamber having an apex portion located furthest away from the concave portion and a cam side extending from the apex portion toward the next chamber;

a plurality of inner bore members provided in the rim portion, each inner bore member communicating with one cam-shaped chamber and extending radially outwardly to an end wall, each inner bore member retaining a reagent or wash solution and having an outlet located near the end wall, the outlet communicating with the circular flange of the specimen holder; and (e) a plurality of plunger members each adapted to be slidely fit in one inner bore member in a water-tight fashion, wherein when the specimen holder is rotated relative to the second housing, the latch member thrusts into each chamber and drives the plunger member into the inner bore member to dispense the reagent or wash solution retained in the inner bore member for testing analyte(s) in the specimen.

2. The assay device of claim 1 wherein the plunger member has a sealing end fit in the inner bore member in a water-tight fashion and a guiding shoulder slidely fit in the inner bore member.

3. The assay device of claim 2 wherein the latch member has a traverse handle.

4. The assay device of claim 2 wherein the second housing has a center hole.

5. The assay device of claim 1 further comprising a blotter member inserted between the bottom of the first housing and the specimen holder.

6. The assay device of claim 1 further comprising a filter member adapted to be attached to the opening in the second housing.

7. The assay device of claim 1 wherein the second housing, the specimen holder, the latch member and the first housing are made of clear plastic.

8. The assay device of claim 1 wherein the outlet of each inner bore member has an enlarged bottom to form a recess.

9. A method for detecting analyte(s) in a specimen comprising the steps of:

adding a specimen of a predetermined quantity into the self-contained assay device of claim 1 through the opening on the second housing;

rotating the specimen holder relative to the second housing to move the remote end of the latch member from a start position along the rim portion of the second housing into the first chamber, thereby drivirg the plunger member into the inner bore member to dispense a reagent or wash solution contained therein;

rotating the specimen holder relative to the second housing to move the spring/latch assembly to the next chamber;

repeating the above step until the latch member thrusts into the last chamber to drive the plunger member into the inner bore member to dispense a reagent or wash solution contained therein;

rotating the specimen holder relative to the second housing to move the spring/latch assembly from the last chamber to an end position; and observing the results.

10. The assay device of claim 1 wherein the circular flange of the specimen holder includes a position located next to the radial slot where the specimen reacts with the reagent.

11. The assay device of claim 10 wherein the reaction position on the circular flange is porous.

12. The assay device of claim 11 further comprising a porous membrane member, the membrane member being attached to the reaction position on the circular flange.

13. The assay device of claim 1 further comprising a knob member, the knob member having a center hole for fixedly fitting onto the pin member of the specimen holder.

14. The assay device of claim 13 wherein the first housing and the knob member each have an orientating device for orientating the first housing and the knob member in an automated operating apparatus.

15. The assay device of claim 14 wherein each orientating device is a recess member.

16. The assay device of claim 1 further comprising first and second retainer members located in the rim portion of the second housing, said first and second retainer members determining a start position and an end position of the assay device when performing assays, the first retainer member being in the same radial direction as the opening for adding the specimen in the second housing.

17. The assay device of claim 16 wherein there are four cam-shaped chambers, the apex portions of the chambers and the first and second retainer members being evenly distributed along the rim portion.

18. The assay device of claim 16 wherein the first and second retainer members are nitch and slot members.

19. The assay device of claim 16 wherein each of the first and second housing has a through hole adapted to align with the second retainer member at the start position.

20. The assay device of claim 1 further comprising a membrane member attached to the circular flange of the specimen holder adjacent to the slot, the membrane member being made of a porous material.

21. The assay device of claim 20 wherein the membrane member further comprises a plurality of zones, each of which binds an assay substance.

22. The assay device of claim 21 wherein the zones on the membrane member are configured as signs "+" and "−" and letters representing bound assay substances.

23. The assay device of claim 21 wherein the zones on the membrane member are configured as signs "+" and "−" and numbers representing the amount of a bound substance.

24. The assay device of claim 21 wherein the zones oil the membrane member are parallel lines.

25. The assay device of claim 24 wherein the zones on the membrane member are in the form of a bar code adapted to use in connection with a bar code reading machine.

26. A self-contained assay device for detecting analyte(s) in a specimen comprising:

(a) a specimen holder having a central portion with at least one radial slot, and a flange portion adapted and configured to hold the specimen to be tested;

(b) at least one spring latch assembly having a spring member and a latch member, each spring latch assembly adapted and configured to be disposed substantially within one radial slot, the latch member having a remote end and configured and adapted to move within the radial slot and the spring member adapted and configured to provide a biasing force to the latch member;

(c) a housing having a rim portion and adapted and configured so that the specimen holder rotates relative to the housing, the rim portion comprising:

an opening for receiving the specimen, the opening communicating with the flange; and a plurality of chambers formed therein, each chamber adapted and configured to communicate with the radial slot and receive the remote end of the latch as the specimen holder is rotated, each chamber having a side wall extending toward the next adjacent chamber, the side wall adapted and configured to move the latch within the radial slot against the biasing force of the spring member as the specimen holder is rotated, each chamber communicating with an inner bore adapted and configured to contain a reagent or wash solution, the inner bore having an outlet communicating with the flange; and (d) a plurality of plunger members, each plunger member adapted and configured to be slidable in one of the plurality of inner bores in a liquid-tight manner, whereby the remote end of the latch moves into at least one chamber as the specimen holder is rotated and engages the plunger to move it into the inner bore to dispense the reagent or washing solution contained in the inner bore through the outlet for testing analyte(s) in the specimen.

* * * * *